US005879220A

United States Patent [19]

Hasegawa et al.

[11] Patent Number: 5,879,220

[45] Date of Patent: Mar. 9, 1999

[54] APPARATUS FOR MIRROR-POLISHING THIN PLATE

[75] Inventors: Fumihiko Hasegawa; Makoto Kobayashi; Fumio Suzuki, all of Fukushima-ken, Japan

[73] Assignee: Shin-Etsu Handotai Co., Ltd., Tokyo, Japan

[21] Appl. No.: 919,164

[22] Filed: Aug. 28, 1997

[30] Foreign Application Priority Data

Sep. 4, 1996 [JP] Japan ..... 8-234391

[51] Int. Cl.[6] ..... B24B 1/00

[52] U.S. Cl. ..... 451/288; 451/285; 451/287; 451/398

[58] Field of Search ..... 451/285, 287, 451/288, 289, 397, 398, 402, 41

[56] References Cited

U.S. PATENT DOCUMENTS

| | | | |
|---|---|---|---|
| 5,205,082 | 4/1993 | Shendon et al. | 451/41 |
| 5,230,184 | 7/1993 | Bukhman | 451/41 |
| 5,423,716 | 6/1995 | Strasbaugh | 451/287 |
| 5,584,751 | 12/1996 | Kobayashi et al. | 451/287 |
| 5,624,299 | 4/1997 | Shendon | 451/288 |

FOREIGN PATENT DOCUMENTS

| | | |
|---|---|---|
| 0 362 811 | 4/1990 | European Pat. Off. . |
| A-5-69310 | 3/1993 | Japan . |
| 7 314 301 | 5/1995 | Japan . |

*Primary Examiner*—Eileen P. Morgan
*Attorney, Agent, or Firm*—Oliff & Berridge, PLC

[57] ABSTRACT

An apparatus for mirror-polishing a thin plate, wherein uniformity of tightness in a stretched condition across an elastic film can be achieved and a polishing pressure distribution on the thin plate is uniformalized, so that constant polishing stock removal is realized and high flatness polishing is made possible. In the apparatus, the thin plate is held on a thin plate support mounted on a rotatable press member and the thin plate is pressed to a polishing means by the press member, and the apparatus has features that a holding surface for the thin plate is formed by a flexible elastic film; the elastic film is fastened to the press member or a part mounted thereto in a condition that the elastic film is sandwiched between a spacer and a holding piece; and a pressure, which presses the thin plate held on the elastic film to the polishing means, is adjusted by applying a back pressure to the thin plate with a fluid feed means, while adjusting tightness of the elastic film by the space.

3 Claims, 4 Drawing Sheets

APPARATUS FOR MIRROR-POLISHING THIN PLATE

BACKGROUND OF THE INVENTION

1. Field of the Invention

The present invention relates to an apparatus for mirror-polishing a thin plate. More particularly, the invention relates to an apparatus for mirror-polishing a thin plate used for mirror-polishing a semiconductor wafer (hereinafter referred to as wafer) to a high flatness.

2. Related Art

In a fabrication process of a semiconductor integrated circuit, for example, a design rule applied to a device has been narrowed and a depth of focus in a stepper in a photolithography step has become shallower in the trend of ever increasing integration of the device. Accordingly, requirement for a higher flatness of a wafer has also become more demanding in a mirror-polishing process for the wafer.

Conventionally, a mechano-chemical polishing method, which is a combination of mechanical polishing and chemical polishing, has been used in an apparatus for mirror-polishing a wafer.

In this mechano-chemical polishing method, a wax method, for example, has been used, comprising: fixing with wax a wafer on a lower surface of a support mounted on a freely rotatable, press member; and subjecting the wafer to abrasion with an unwoven polishing pad, as a plashing means, fixed on a major surface of a turn table, while being pressed. In the wax method, however, there are technical limitations to improvement on a flatness of the wafer, since it is difficult to apply the wax on the lower surface of a support uniformly and foreign matter invades into a gap between the wafer and the lower surface of a support, so that generation of dimples can not be avoided.

A waxless method has been also used, in which a wafer is held on a lower surface of the support with a backing pad in a state of sponge lying therebetween and the wafer is polished in a similar way to that of the polishing process in the above mentioned wax method. In this waxless method, however, there is also a problem that pores on the surface of the backing pad in the state of sponge are loaded with solids in polishing slurry or the like and an elasticity of the pad is locally changed, so that a flatness of the wafer is degraded. Accordingly, in the waxless method, there is a requirement that frequent exchanges of backing pads are indispensable in order to prevent degradation in flatness of the wafer.

In consideration of such circumstances, an apparatus for mirror-polishing, which adopts an elastic film holding method, as disclosed in Laid-open Japanese Patent Application No. 5-69310, has been recently proposed. This apparatus employs, as shown in FIG. 4, an elastic film 91 with flexibility on a supporting surface thereof for the wafer. As an material of the elastic film 91, a sheet made of synthetic rubber such as silicone rubber or the like, or a reinforced rubber or reinforced vinyl resin with any of fibers and cloth or the like is used. In such an apparatus for mirror-polishing, the elastic film 91 is fastened on a cylinder-like holder body 92 with application of uniform tension, a surface (back surface) of the film opposed to the surface thereof, on which the wafer is held, is exposed to a pressure adjusting fluid for pressing the wafer, said fluid is supplied from a fluid feed/exhaust apparatus, not shown. A ring 94 is mounted on the outer periphery of the holder 92, as shown in FIG. 5, in such a manner that the ring 94 is free to movable vertically, the thin elastic film 91 is adhered or mechanically fixed in a squeezing manner on the film 94 and the ring 94 is adjustably moved upward or downward with a screw 95, so that the thin elastic film may be tightened in a uniform manner. A mark 96 indicates a polishing pad fixedly held on a major surface of a turn table.

The above apparatus for mirror-polishing still has a problem. In order to attain a uniform polishing stock removal on a wafer, conditions of tightness of the elastic film 91 are important. In the apparatus employing the elastic film holding method, the screw 95 works for vertical shifts of the ring 94 in order to adjust the tightness of the elastic film 91 but it is difficult to properly determine a position itself of the ring on the outer surface of the holder 92 by adjusting a degree of clamping-down of each screw 95 and besides it is more difficult to uniformalize clamping-down degrees of screws 95, said screws 95 being located on the outer periphery of the holder 92. For the above reason, in the apparatus, uniform tightness across the elastic film 91 working as a holding surface for a wafer W has not been achieved. In the apparatus, moreover, since the outer periphery of the holder 92 and the inner periphery of the ring 94 are respectively uniform in diameter, a gap is easy to be created between the outer periphery of the holder 92 and the inner periphery of the ring 94, which leads to another problem that such a structure has poor gastightness or fluidtightness.

Such problems are not restricted to the case of a semiconductor wafer but generally occur in mirror-polishing of a thin plate.

SUMMARY OF THE INVENTION

The present invention was made in view of the above mentioned problem in the prior art. It is, accordingly, an object of the present invention to provide an apparatus for mirror-polishing a thin plate, in which tightness across an elastic film can be uniform and thereby a distribution of a polishing force on the thin plate is uniformalized, so that polishing stock removal becomes constant and polishing with a high flatness can be attained.

A first aspect of the present invention is directed to an apparatus for mirror-polishing a thin plate, wherein the thin plate is held on a thin plate support mounted on a rotatable press member and the thin plate is pressed to a polishing means by the press member, comprising: a flexible elastic film forming a holding surface for the thin plate; a spacer and a holding piece between which the elastic film is sandwiched, wherein the elastic film is mounted to the press member or a part mounted thereto in a condition that the elastic film is sandwiched therebetween; and a fluid feed means for applying a back pressure to the elastic film to adjust a pressure to press the polishing means with the thin plate W held on the elastic film, while adjusting tightness of the elastic film by the spacer.

According to the apparatus for mirror-polishing, a degree of tightness of an elastic film can be adjusted by changing a thickness of a spacer and the tightness of the elastic film can be uniform across the whole holding surface for the thin plate, so that the thin plate can be mirror-polished in a uniform manner.

A second aspect of the present invention is directed to an apparatus for polishing a thin plate defined in the first aspect, wherein: the press member comprises a rotatable shaft and a holder mounted on the lower end; the outer peripheral surface of the holder has a taper in such a manner that a diameter of the holder expands as it is farther from the polishing means; a flange is mounted at the farthest end of a tapered portion of the holder, said flange extending outwardly; the spacer and the holding piece are formed in the shape of a ring and fixed to the flange with bolts; and a press ring in the shape of a ring to press the elastic film to the outer periphery of the holder is also fixed to the flange.

According to the apparatus, since the press ring in the shape of a ring to press the elastic film to the outer peripheral surface of a holder is mounted, a leakage of fluid at the pressing position by the press ring can be prevented and besides the thin plate to be polished can be pressed to the polishing means under a proper pressure.

BRIEF DESCRIPTION OF THE DRAWING

Novel features which are considered characteristic of the present invention are set forth with particularity in the appended claims.

The invention itself, however, and additional objects and advantages thereof will best be understood from the following description thereof when read in connection with accompanying drawings, in which.

DETAILED DESCRIPTION OF THE INVENTION

Figure 1:
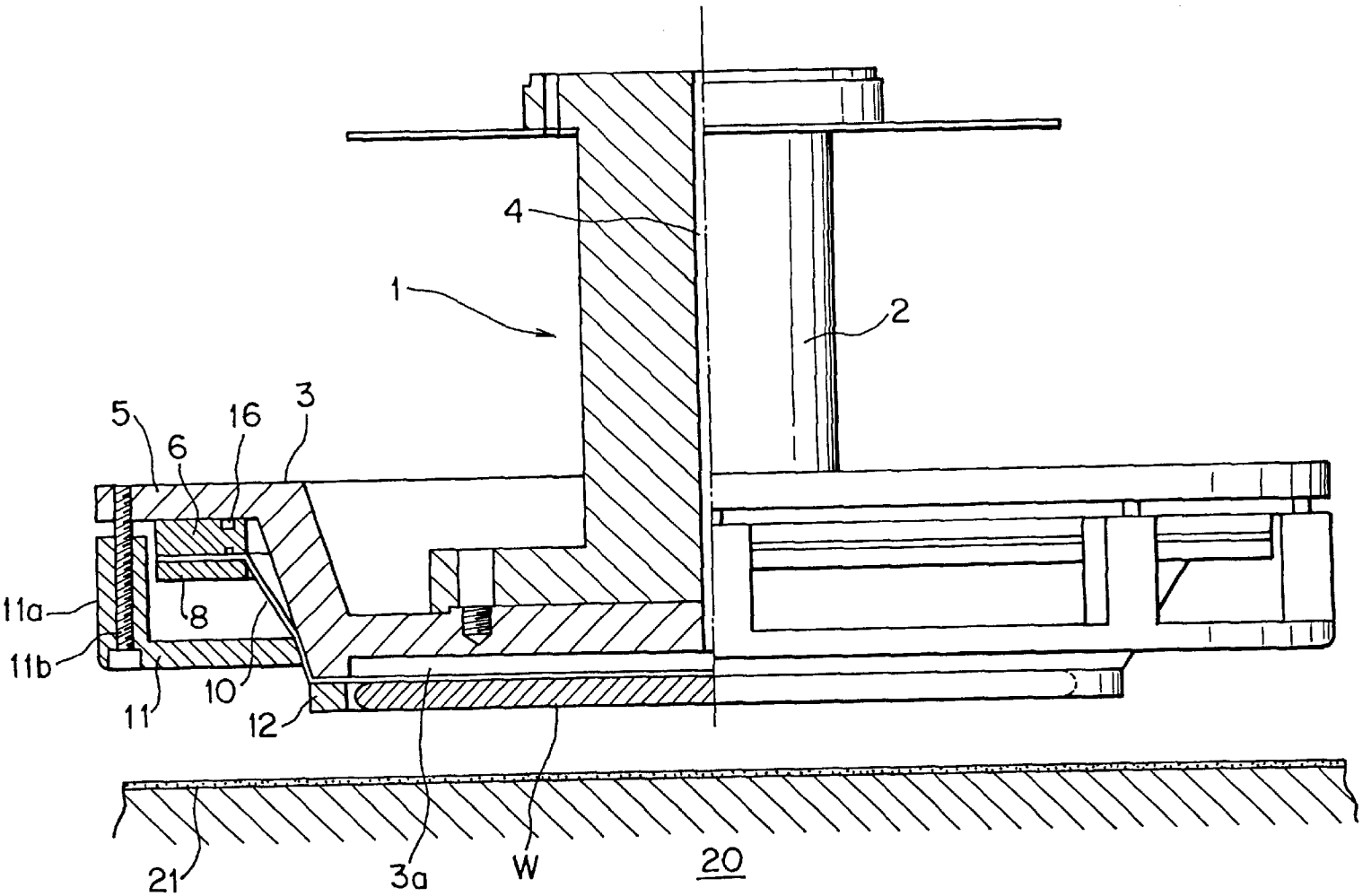
FIG. 1 is a schematic view partly in section showing a press member and parts in the neighborhood of an apparatus for mirror-polishing a thin plate according an embodiment of the present invention.
Figure 2:
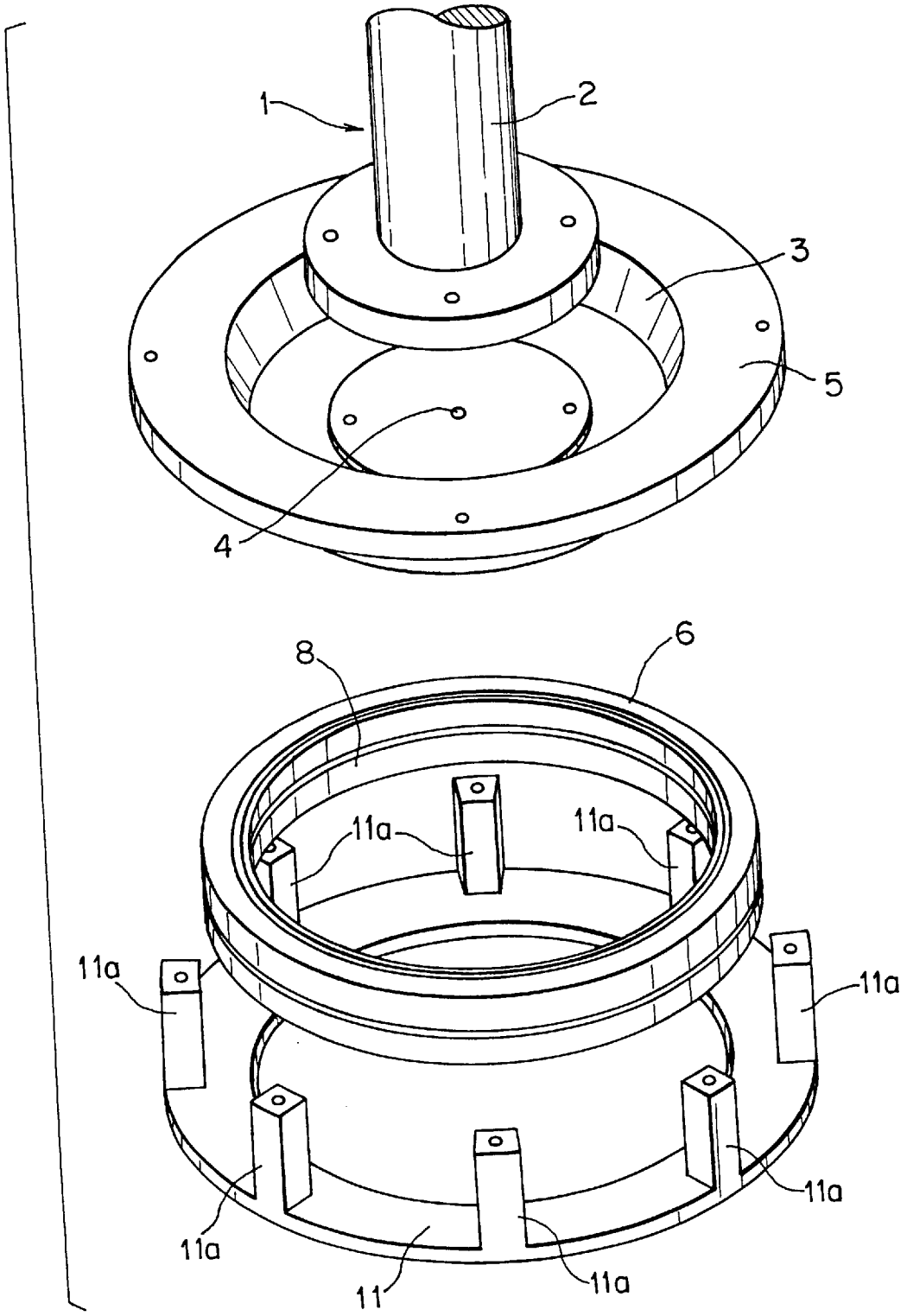
FIG. 2 is an exploded, perspective view showing the press member and parts in the neighborhood.

An embodiment of an apparatus for mirror-polishing a thin plate of the present invention will be described in reference to the accompanying drawings below: FIG. 1 is a front view, sectional in the left half, showing a press member of the apparatus of mirror-polishing and parts in the neighborhood and FIG. 2 is an exploded, perspective view showing the press member and parts in the neighborhood.

In the figures, 1 indicates a press member and the press member 1 has a shaft 2 which is rotatably supported by a body (not shown) of the apparatus for mirror-polishing. A holder 3 having a shape of dish is fastened on the lower end of the shaft 2 with bolts.

The holder 3 has a concave portion 3*a* at a lower side thereof and an elastic film 10 is fixed to cover the concave portion 3*a* to form a closed space, which is a reservoir for a fluid. A fluid path 4, which is formed in the middle portion of the shaft 2 and the holder 3, has an opening in the concave portion 3*a*. The fluid path 4 is communicated with a fluid feed/exhaust apparatus (not shown) and the fluid is fed to or exhausted from the concave portion 3*a* through the fluid path 4. As material for an elastic film 10, sheet made of synthetic rubber such as silicon rubber, or sheet made of rubber or vinyl plastics reinforced with fibers or cloth is used, which has been conventionally used.

A taper is formed on the outer peripheral surface of the holder 3 in such a manner that a diameter thereof expands in an upward direction. A flange 5 is mounted at the uppermost end of the taper of the holder 3. The edge portion of the elastic film 10 is sandwiched between a spacer 6 and a holding piece 8 and the three members are fastened to the flange 5 with bolts.

Figure 3:
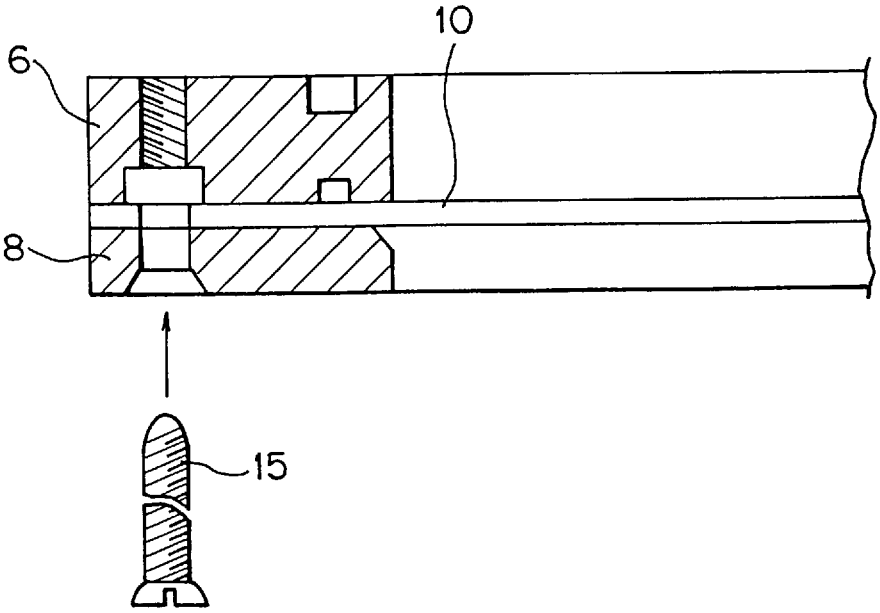
FIG. 3 is a view in vertical section showing edge portions of a spacer and a holding piece of FIG. 1.
Figure 4:
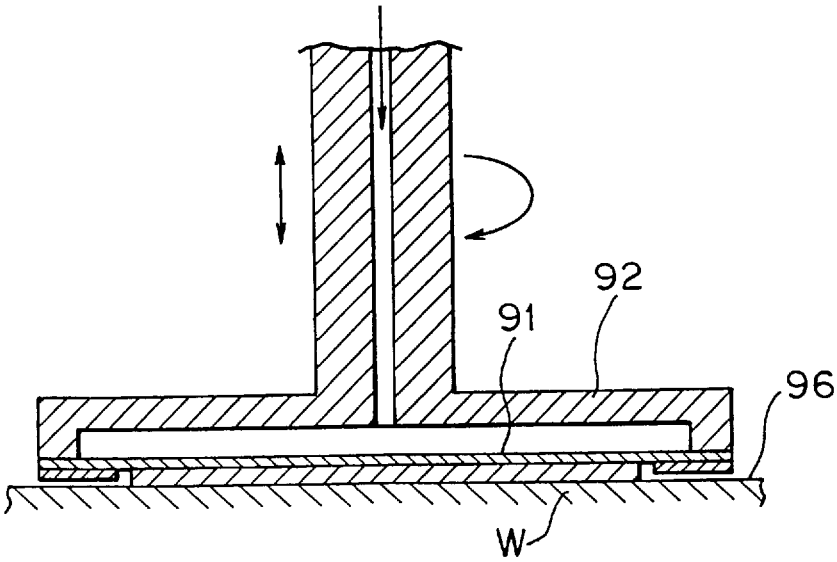
FIG. 4 is a schematic sectional view showing a press member and parts in the neighborhood of a conventional apparatus for mirror-polishing.
Figure 5:
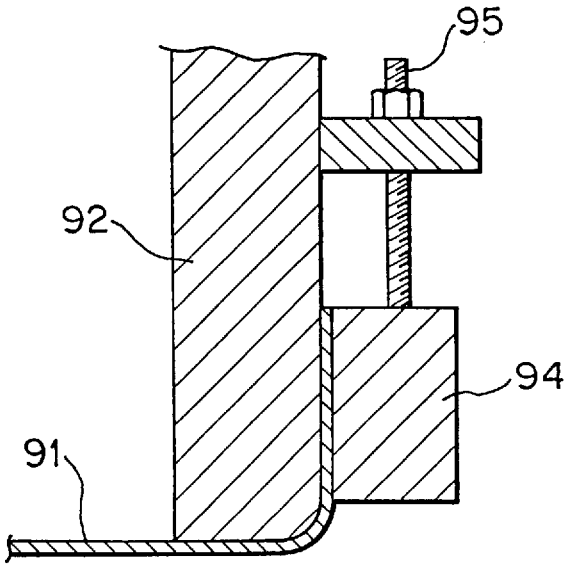
FIG. 5 is a vertical sectional view showing an end portion of the press member of FIG. 4.

The spacer 6 has a shape of ring and an inner hole thereof can be fitted in a loose manner on the outer peripheral surface of the holder 3. The spacer 6 is a component to adjust a tightness of the elastic film 10 and spacers having various kinds of thickness are in stock in order to adjust a degree of tightness. The holding piece 8 has a shape of ring in the same way as the spacer does and an inner hole of the holding piece 8 can be also fitted on the outer peripheral surface of the holder 3 in a loose manner. The holding piece 8 and the spacer 6 are fixed to the flange 5 with bolts in a condition that the elastic film 10 is sandwiched between them, as shown in FIG. 3. In order to achieve such a configuration, the spacer 6 and the holding piece 8 have threaded holes at corresponding positions to each other and the elastic film 10 has also holes at the corresponding positions. A mark 16 in FIG. 1 indicates an O-ring.

A press ring 11 is mounted to the flange 5 of the holder 5. The inner peripheral surface of the press ring 11 has the same taper as that of the outer peripheral surface of the holder 3. Eight vertical poles 11*a* are elected along the outer periphery of the press ring 11 at an equi-distance. The press ring 11 is fixedly mounted to the flange 5 with bolts 11*b* engaging in threaded holes of the vertical poles 11*a*.

A Template 12 is mounted on the lower side of the elastic film 10. More particularly, the template 12 is mounted to the elastic film 10 so that the periphery thereof is located on the lower side of the wall portion of the holder 3 delineating the concave portion 3*a* which is a bottom portion of the holder 3. The template 12 is used to determine a thickness of a polished thin plate like wafer W. As material for a template 12, for example, a laminated plate made of glass fibers impregnated with epoxy resin is used.

Next, how to run the apparatus for mirror-polishing will be described.

The spacer 6, the holding piece 8 and the elastic film 10 are mounted to the flange 5 of the holder 3 with bolts, while the elastic film 10 is sandwiched between the others. On this occasion, the spacer is selected so as to have a thickness giving the elastic film 10 a desired tightness. Then, the press ring 11 is mounted to the flange 5 of the holder 3 with the bolts 11*b* and the template having a predetermined thickness is adhered on the lower side of the elastic film 10.

A wafer W is disposed in a close contact on an open area of the elastic film 10 delineated by the template 12. The close contact of the wafer W is achieved in such a manner that, for example, firstly an upper surface of the wafer W is made wet with water and secondly the wet upper surface of the wafer W is, in close contact, placed on the elastic film 10. After the wafer W is placed on the elastic film 10, a pressure in the concave portion 3*a* is set at a predetermined value by the fluid feed/exhaust apparatus and at the same time the shaft 2 is moved downward to press the wafer W to a polishing pad 21 on the turn table 20. In this condition, the turn table 20 is rotated, while supplying a polishing agent, and the shaft 2 is automatically rotated by the rotation the turn table 20, which is resulted in rotation of the wafer W and have the wafer W mirror-polished. As fluid in the fluid feed/exhaust apparatus, gas such as air or nitrogen, or liquid such as water or oil is used.

According the apparatus for mirror-polishing as described above, a degree of tightness of the elastic film 8 in a working condition can be adjusted by selection of a thickness of the spacer 6 and at the same time a tightness of the elastic film 8 can be made uniform all over the surface of its own. Therefore, the wafer W is uniformly mirror-polished.

Moreover, the press ring is mounted on the outer peripheral surface of the holder 3 in order to press the elastic film 10 to the surface, Thereby leakage of fluid is prevented at the peripheral position where the elastic film 10 is pressed to the surface and the wafer W can be pressed to the polishing pad 21 at a proper pressure.

In the above description, one embodiment of the present invention has been disclosed, but the invention is not limited to the description. It is needless to say that various modifications and changes therein can be made without departing from the scope of the invention.

To sum up, in an apparatus of the present invention which is so constructed that a thin plate is held on a thin plate support of a press member and the thin plate is pressed to a polishing means by the press member to be polished, a surface, which hold the thin plate, is formed with a flexible elastic film and the elastic film is mounted to the press member or a part mounted to the member, while the elastic film is sandwiched between a spacer and a holding piece; a back pressure is applied on the backside of the thin film by a fluid feed means to adjust a pressure which press the thin plate to the polishing means, while tightness of the elastic film is adjusted with a spacer, so that tightness across the elastic film is uniformalized and the thin plate can be mirror-polished in a uniform manner.

What is claimed is:

1. An apparatus for polishing a thin plate, wherein the thin plate is positioned by a thin plate support mounted on a rotatable press member and the thin plate is pressed against a polisher by the press member, the apparatus comprising:

a flexible elastic film forming a pressing surface for pressing the thin plate;

a first interchangeable spacer in contact with a first side of the flexible elastic film;

a holding piece for attaching to the press member and in contact with a second side of the flexible elastic film opposite the first side of the flexible elastic film, the elastic film being securely held between the first interchangeable spacer and the holding piece; and a fluid feeder communicating with the first side of the elastic film and applying a first pressure to the first side of the elastic film to adjust a second pressure for pressing the thin plate against the polisher, a tightness of the elastic film being adjustable by replacing the first interchangeable spacer with a second interchangeable spacer having a different size.

2. An apparatus for polishing a thin plate according to claim 1, wherein the press member comprises a rotatable shaft and a holder mounted on a first end thereof, an outer peripheral surface of the holder is tapered such that a diameter of the outer peripheral surface increases in a direction away from the polisher, a flange is mounted at an end of the tapered portion of the holder farthest from the polisher, the first interchangeable spacer and the holding piece are formed in the shape of rings and fixed to the flange with bolts, and a press ring in the shape of a ring is fixed to the flange and presses the elastic film against the outer peripheral surface of the holder.

3. An apparatus for polishing a thin plate, wherein the thin plate is positioned by a thin plate support mounted on a rotatable press member and the thin plate is pressed against a polisher by the press member, the apparatus comprising:

a flexible elastic film forming a pressing surface for pressing the thin plate;

a first interchangeable spacer in contact with a first side of the flexible elastic film;

a template attached to the second side of the flexible elastic film for controlling a position of the thin plate in a direction perpendicular to the polisher;

a holding piece for attaching to the press member and in contact with a second side of the flexible elastic film opposite the first side of the flexible elastic film, the elastic film being securely held between the first interchangeable spacer and the holding piece;

a holder for attaching to the press member and having an outer peripheral surface;

a press ring adjustably attached to the holder by bolts and pressing the flexible elastic film against the outer peripheral surface of the holder, the press ring being drawn toward the holder by rotating the bolts and causing the flexible elastic film to be tightened to provide a seal between the flexible elastic film and the outer peripheral surface of the holder; and a fluid feeder communicating with the first side of the elastic film and applying a first pressure to the first side of the elastic film to adjust a second pressure for pressing the thin plate against the polisher, a tightness of the elastic film being adjustable by replacing the first interchangeable spacer with a second interchangeable spacer having a different size.

* * * * *